United States Patent [19]

Koiwa

[11] Patent Number: 5,014,675

[45] Date of Patent: May 14, 1991

[54] IGNITION APPARATUS FOR AN INTERNAL COMBUSTION ENGINE

[75] Inventor: Mitsuru Koiwa, Himeji, Japan

[73] Assignee: Mitsubishi Denki Kabushiki Kaisha, Tokyo, Japan

[21] Appl. No.: 522,777

[22] Filed: May 14, 1990

[30] Foreign Application Priority Data

May 15, 1989 [JP] Japan ..... 1-118753
May 15, 1989 [JP] Japan ..... 1-118754

[51] Int. Cl.[5] ..... F02P 3/045
[52] U.S. Cl. ..... 123/609; 123/618
[58] Field of Search ..... 123/617, 618, 609, 644, 123/651

[56] References Cited

U.S. PATENT DOCUMENTS 4,271,812 6/1981 Bodig et al. ..... 123/609
4,367,721 1/1983 Boyer ..... 123/618 X
4,397,290 8/1983 Tanaka et al. ..... 123/618

*Primary Examiner*—Tony M. Argenbright
*Attorney, Agent, or Firm*—Sughrue, Mion, Zinn, Macpeak and Seas

[57] ABSTRACT

An ignition apparatus for an engine reduces the duty cycle of a power transistor circuit for controlling the primary winding current of an ignition coil over the entire operating range of the engine including low and high speeds. In one embodiment, a signal generator generates an alternating output signal which is fed through a resistor to a wave form shaper for comparison with a threshold voltage. As long as the signal generator output is higher than the threshold voltage, the wave form shaper generates an output pulse for controlling a conduction time of the power transistor circuit. When the engine is operating at low speeds, the pulse width of the wave form shaper output is reduced by partially absorbing the signal generator output by a current absorbing circuit which is disabled at high engine speeds. In another embodiment, at high engine speeds, a DC current is supplied from a DC power source to a signal generator via a resistor through a current supply circuit which is disabled by a switching transistor at low enging speeds. In both of the embodiments, the signal generator has one end connected to ground and the other end connected at a single external connection point with the wave form shaper through the resistor.

9 Claims, 4 Drawing Sheets

IGNITION APPARATUS FOR AN INTERNAL COMBUSTION ENGINE

BACKGROUND OF THE INVENTION

This invention relates to an ignition apparatus for a spark-ignited internal combustion engine. More particularly, it relates to an ignition apparatus which controls ignition timing of a spark plug by means of a signal which is generated by a signal generator in synchrony with the rotation of an engine.

In order to carry out proper ignition in an internal combustion engine, it is necessary for the current flowing through the primary winding of the ignition coil for the engine to reach a prescribed level. On the other hand, if the primary winding current exceeds this prescribed level, electric power from the storage battery for the engine, which is used to energize the ignition coil will be needlessly consumed.

Therefore, many engines are equipped with ignition controllers which prevent the primary winding current from exceeding a prescribed current limit. A typical example of an ignition apparatus including such an ignition controller is illustrated in FIG. 4. The ignition apparatus illustrated includes a signal generator 1 which generates an alternating output signal in synchrony with the rotation of an internal combustion engine. A resistor 2 is connected at its one end with the positive terminal of a DC power source 50 and grounded at its other end through a resistor 3 and a pair of serially connected diodes 4, 5. A pair of transistors 6, 7 have their collectors commonly connected with the positive terminal of the DC power source 50, and their emitters commonly connected with one end of the signal generator 1 through a first external connection point C1 and at the same time commonly grounded through a resistor B. A transistor 9 has a base coupled with a connection point between the resistors 2, 3, a collector coupled with the positive terminal of the DC power source 50, and an emitter grounded through a resistor 10. A wave form shaper 12 has a first positive input terminal connected with the signal generator 1 through a second external connection point C2, a second negative input terminal coupled with the emitter of the transistor 9 through a resistor 11, and an output terminal coupled with an input side of a driver circuit 16 for driving a power transistor circuit 17. A transistor 14 has a base coupled via a resistor 15 with the output terminal of the wave form shaper 12, a collector coupled via a resistor 13 with the second negative input terminal of the wave form shaper 12, and an emitter grounded. The driver circuit 16 is connected at its output side with the power transistor circuit 17 which includes a pair of transistors 17*a*, 17*b*. The transistor 17*a* has a base coupled with the output side of the driver circuit 16, a collector coupled with a collector of the transistor 17*b*, and an emitter coupled with a base of the transistor 17*b* which has an emitter grounded through a resistor 19. The ignition coil 18 includes a primary winding connected at its one end with the positive terminal of the DC power source 50 and at its other end with the collectors of the transistors 17*a*, 17*b*, and a secondary winding which is connected with a spark plug (not shown). A current detecting circuit 21 has a positive input terminal coupled with the emitter of the transistor 17*b*, a negative input terminal coupled with the positive terminal of a DC power source 20, and an output terminal coupled through a resistor 22 with a base of a transistor 23. The transistor 23 has an emitter grounded and a collector coupled with one end of a resistor 24 which is coupled at the other end thereof with the other end of the signal generator 1 through the second external connection point C2. The resistor 24 is coupled at one end with an anode of a diode 25 which is in turn coupled at its cathode with one end of a capacitor 26 which is grounded at its other end. A buffer circuit 28 has a positive input terminal coupled with a connection point between the cathode of the diode 25 and the capacitor 26, a negative input terminal coupled with an output terminal thereof, and an output terminal with a base of the transistor 7.

All the above-described elements other than the signal generator 1, the ignition coil 18 and the DC power source 50 constitute an ignition controller which is electrically connected with the signal generator 1 through the first and second external connection points C1 and C2.

The above-described ignition apparatus operates as follows. The signal generator 1 generates, in synchrony with the rotation of the engine, an alternating ouput signal which is inputted to the wave form shaper 12 where the alternating output signal is shaped into an appropriate pulse signal. Namely, the wave form shaper 12 compares the input signal inputted to the first positive input terminal from the signal generator 1 with a reference or threshold voltage which is imposed upon the second negative input terminal of the wave form shaper 12 by the DC power source 50 through the transistor 9 and the resistor 11. When the alternating output signal of the signal generator 1 fed to the positive input terminal of the wave form shaper 12 is greater than the reference or threshold voltage at the negative input terminal thereof, the wave form shaper 12 generates an output signal in the form of a square pulse. The pulse signal thus generated is inputted through the driver circuit 16 to the power transistor circuit 17 for turning it on and off. Specifically, when an output signal of the driver circuit 16 is imposed upon the base of the transistor 17*a*, the transistor 17*a* is made conductive whereby a current is supplied through the now conductive transistor 17*a* to the base of the transistor 17*b*. As a result, the transistor 17*b* is also made conductive so that a current flows from the positive terminal of the DC power source 50 to ground through the primary winding of the ignition coil 18, the transistor 17*b* and the resistor 19.

On the other hand, when the driver circuit 16 stops generating the output signal, the transistors 17*a*, 17*b* are made non-conductive so that the current flowing through the primary winding of the ignition coil 18 is interrupted. Upon interruption of the primary winding current, a high voltage is developed in the secondary winding whereby the unillustrated spark plug electrically sparks, thus igniting a cylinder of the engine. The output signal of the wave form shaper 12 is also fed to the base of the transistor 14 through the resistor 15 whereby the transistor 14 is made conductive, thus changing the reference or threshold voltage level at the second negative input terminal of the wave form shaper 12.

In the above ignition apparatus, the duty cycle of the power transistor circuit 17 which controls the primary winding current of the ignition coil 18 is controlled in accordance with the voltage across the capacitor 26. The capacitor 26 is charged by the output signal of the signal generator 1 through the resistor 24 and the diode 25. When the engine is operating at a speed (i.e., in a high speed range) such that the charged voltage across the capacitor 26, which increases in accordance with increasing rotational speed of the engine and which is inputted to the first positive terminal of the buffer circuit 28, exceeds a prescribed level corresponding to a reference voltage at the negative input terminal of the buffer circuit 28, the buffer circuit 28 produces an output signal which is inputted to the base of the transistor 7 so that the transistor 7 is made conductive. The output signal of the buffer circuit 28 is also fed back to the negative input terminal thereof so as to provide the reference voltage. With the conduction of the transistor 7, a direct current is fed from the DC power source 50 to the signal generator 1 through the transistor 7 and the first external connection point C1 so as to raise the entire level of the alternating output signal of the signal generator 1 fed to the wave form shaper 12. As a result, the wave form shaper 12 generates an output signal in the form of a square pulse having a pulse width sufficient for providing an adequate primary winding current for the high speed operation of the engine.

When the primary winding current reaches an upper limit, the signal inputted to the first positive input terminal of the current detecting circuit 21 becomes equal to the reference or threshold voltage at the second negative input terminal so that the current detecting circuit 21 generates an output signal which is fed to the base of the transistor 23 through the resistor 22 whereby the transistor 23 is made conductive. As a result, the output signal of the signal generator 1 flows through the resistor 24 and the transistor 23 to ground while bypassing the capacitor 26. Accordingly, the transistor 7 is made nonconductive, interrupting the current supply from the DC power source 50 to the signal generator 1. In this manner, the duty cycle of the power transistor circuit 17 is controlled so that the interrupting current of the ignition coil 18 is made constant even in the high speed operating range of the engine, thus preventing a wasteful consumption of electric power.

When the engine is rotating at a low speed and the voltage across the capacitor 26 is below the prescribed level, the buffer circuit 28 generates no output signal so that the transistor 7 is non-conductive, interrupting the current supply from the DC power source 50 to the signal generator 1.

The above-described ignition apparatus, however, possesses the following disadvantages: 1) the circuit arrangement for controlling the duty cycle is relatively complicated; 2) the number of component parts is relatively large; 3) there are two external electrical connection points formed between the signal generator and the ignition controller; and 4) due to the above problems, the reliability of the entire apparatus is poor, and the manufacturing cost becomes high.

SUMMARY OF THE INVENTION

Accordingly, the present invention is intended to obviate the above problems of the known ignition apparatus.

It is an object of the present invention to provide an ignition apparatus for an internal combustion engine which is simple in arrangement, less in the number of component parts, improved in reliability, and can be manufactured at low costs.

In accordance with one aspect of the present invention, there is provided an ignition apparatus for an internal combustion engine comprising:

a signal generator for generating an alternating output signal in synchrony with the rotation of the engine;

a wave form shaper connected to receive the output signal of the signal generator for shaping the generator output signal using a predetermined threshold, the wave form shaper generating an output signal when the output signal of the signal generator is greater than the predetermined threshold;

a resistor connected in series with the signal generator and the wave form shaper;

current absorbing means connected between the resistor and the wave form shaper for absorbing part of the output signal of the signal generator supplied to the wave form shaper through the resistor in response to the output signal of the wave form shaper;

an ignition coil having a primary winding and a secondary winding; and a first switching element for controlling primary winding current of the ignition coil based on the output signal of the wave form shaper.

Preferably, the current absorbing means comprises:

a current mirror circuit including a pair of first and second transistors having their bases commonly coupled with a collector of the second transistor, and their emitters grounded, the first transistor having a collector coupled with the resistor;

a second switching element connected between the collector of the second transistor and the wave form shaper for controlling the operation of the current absorbing means in response to the output signal of the wave form shaper, the second switching element being operable to turn on the current absorbing means when the wave form shaper generates an output signal and turn it off at other times;

a DC power source; and a voltage regulator connected between the DC power source and the collector of the second transistor for regulating the voltage supplied from the DC power source to the second transistor collector whereby the output signal of the signal generator inputted to the wave form shaper is reduced in dependence upon the collector voltage of the second transistor applied thereto by the DC power source so as to reduce the duty cycle of the first switching element.

Preferably, the voltage regulator comprises a first resistor connected between the DC power source and the collector of the second transistor, a second resistor and a Zener diode connected in series with the second resistor. The second resistor and the Zener diode are connected between the DC power source and the collector of the second transistor in parallel with the first resistor.

According to another aspect of the present invention, there is provided an ignition apparatus for an internal combustion engine comprising:

a signal generator for generating an alternating output signal in synchrony with the rotation of the engine;

a wave form shaper connected to receive the output signal of the signal generator for shaping the generator output signal using a predetermined threshold, the wave form shaper generating an output signal when the output signal of the signal generator is greater than the predetermined threshold;

a resistor connected in series with the signal generator and the wave form shaper;

a capacitor connected to receive the alternating output signal of the signal generator so as to be charged thereby;

current supplying means connected between the resistor and the wave form shaper for supplying a direct current to the resistor in accordance with the charged voltage across the capacitor;

an ignition coil having a primary winding and a secondary winding;

a first switching element for controlling primary winding current of the ignition coil based on the output signal of the wave form shaper;

a current detecting circuit for detecting a current flowing through the primary winding of the ignition coil and generating an output signal when the primary winding current reaches a prescribed level; and a bypass circuit for bypassing the output signal of the signal generator around the capacitor in response to the output signal of the current detecting circuit so that the charged voltage across the capacitor is thereby controlled, adjusting the duty cycle of the switching element.

Preferably, the current supplying circuit comprises:

a DC power source;

a current mirror circuit including a pair of first and second transistors having their emitters commonly coupled with the DC power source and their bases commonly coupled with a collector of the second transistor, the first transistor having a collector coupled with the resistor; and a switching transistor having a collector coupled with the collector of the second transistor, an emitter grounded through a resistor, and a base connected through a buffer circuit with the capacitor, the buffer circuit having a first input terminal coupled with the capacitor, a second input terminal coupled with the emitter of the switching transistor and an output terminal coupled with the base of the switching transistor.

The signal generator has one end connected with said resistor and the other end connected to ground.

DESCRIPTION OF THE PREFERRED EMBODIMENTS

The present invention will now be described in detail with reference to a few presently preferred embodiments thereof as illustrated in the accompanying drawings.

Figure 1:
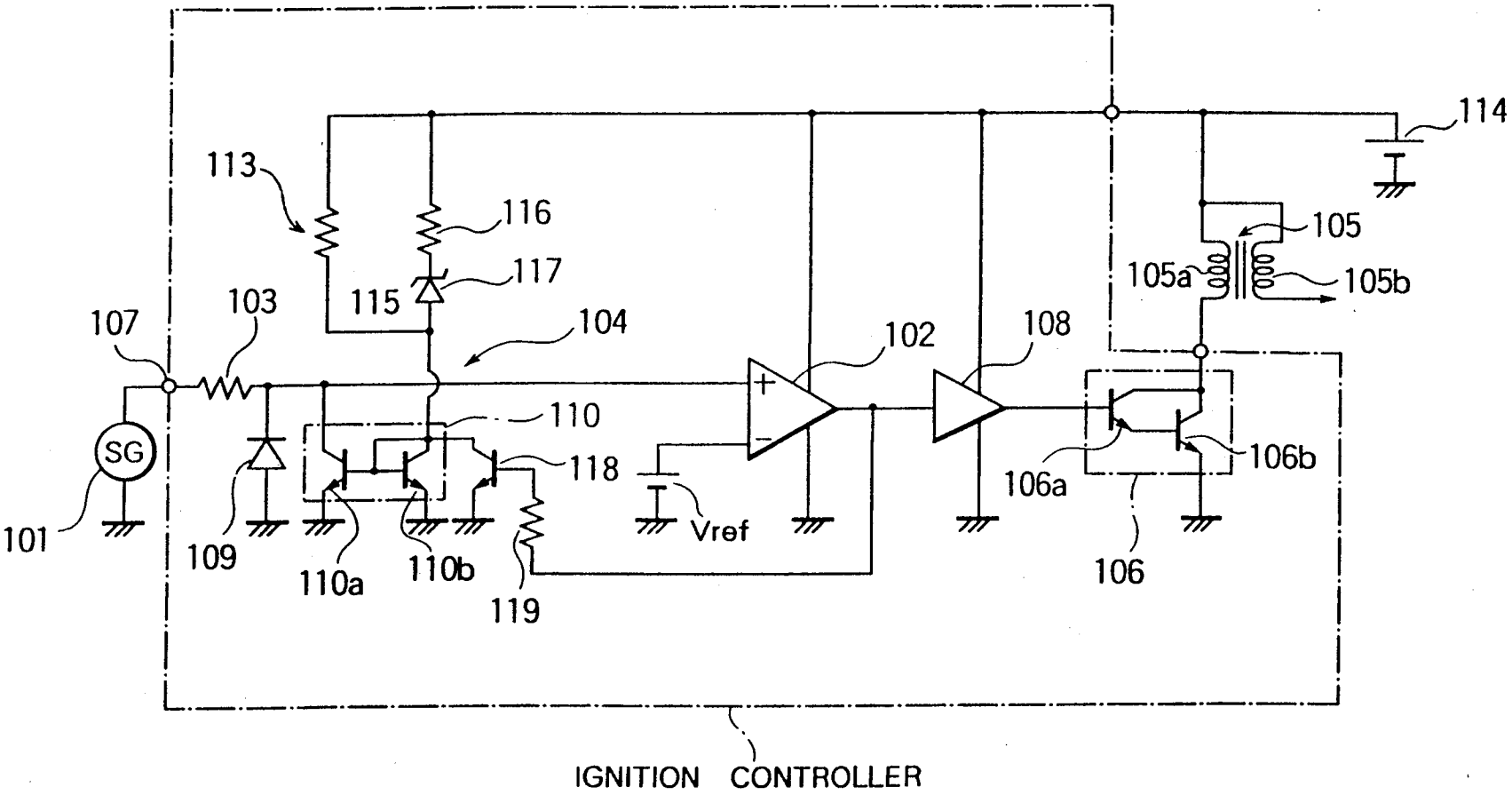
FIG. 1 is a circuit diagram of an embodiment of an ignition apparatus for an internal combustion engine according to the present invention.

Referring to the drawings and first to FIG. 1 which schematically illustrates a first embodiment of an ignition apparatus for an internal combustion engine according to the present invention, the ignition apparatus illustrated comprises a signal generator 101 for generating an alternating output signal in synchrony with the rotation of an engine (not shown), a wave form shaper 102 connected to receive the output signal of the signal generator 101 for shaping the generator output signal using a predetermined threshold, a resistor 103 connected in series with the signal generator 101 and the wave form shaper 102, a current absorbing means 104 connected between the resistor 103 and the wave form shaper 102 for absorbing part of the output signal of the signal generator 101 supplied to the wave form shaper 102 through the resistor 103 in response to the output signal of the wave form shaper 102, an ignition coil 105 having a primary winding 105*a* and a secondary winding 105*b*; and a first switching element 106 for controlling primary winding current of the ignition coil 105 based on the output signal of the wave form shaper 102.

The signal generator 101 has one end connected with one end of the resistor 103 via an external connection point 107 and the other end grounded.

The wave form shaper 102 has a first positive input terminal connected with the other end of the resistor 103, a second negative input terminal to which a predetermined reference or threshold voltage Vref is inputted, and an output terminal which is connected with an input side of a driver circuit 108 which is in turn connected at its output side with the first switching element 106 in the form of a power transistor circuit for controlling the current flowing through the primary winding 105*a* of the ignition coil 105. The wave form shaper 102 compares the alternating output signal of the signal generator 101, which is inputted through the resistor 103 to the first input terminal thereof, with the predetermined threshold voltage Vref and generates an output signal when the output signal of the signal generator is greater than the predetermined threshold voltage Vref. The output signal generated by the wave form shaper 102 is, for example, in the form of square pulses each having a rising edge occurring when the alternating output signal is increasing above the threshold voltage Vref and a falling edge occurring when the alternating output signal is decreasing below the threshold voltage Vref.

A diode 109 has an anode grounded and a cathode connected with the first positive input terminal of the wave form shaper 102 for clipping a negative portion of the signal generator output at a prescribed level.

The first switching element or power transistor circuit 106 comprises a Darlington pair including a pair of first and second power transistors 106*a*, 106*b*. The first power transistor 106*a* has a collector coupled with one end of the primary winding 105*a* of the ignition coil 105, an emitter grounded and a base coupled with an emitter of the second power transistor 106*b* which is coupled at its base with the output side of the driver circuit 108 and at its collector coupled with the one end of the primary winding 105*a*. The other end of the primary winding 105*a* is connected with the positive terminal of a DC power source 114 and the secondary winding 105*b*.

The current absorbing means 104 includes a current mirror circuit 110 having a pair of first and second transistors 110*a*, 110*b* which have their bases commonly coupled with a collector of the second transistor 110*b*, and their emitters grounded. The first transistor 110*a* has a collector coupled with the resistor 103. The collector of the second transistor 110*b* is connected through a voltage regulator 113 with the positive terminal of the DC power source 114.

The voltage regulator 113 comprises a first resistor 115 connected between the DC power source 114 and the collector of the second transistor 110*b*, a second resistor 116 and a Zener diode 117 connected in series with the second resistor 116. The second resistor 116 and the Zener diode 117 are connected between the DC power source 114 and the collector of the second transistor 110*b* in parallel with the first resistor 115. The voltage regulator 113 controls the voltage supplied from the DC power source 114 to the second transistor collector so that the output signal of the signal generator 101 inputted to the wave form shaper 102 is reduced in dependence upon the collector voltage of the second transistor 110*b* applied thereto by the DC power source 114, thus reducing the duty cycle of the power transistor circuit 106. Specifically, the collector voltage of the second transistor 110*b* supplied by the DC power source 114 is changed by controlling a gate voltage imposed on the Zener diode 117. For example, increasing the gate voltage above a specified threshold or Zener voltage Vs results in a rapid decrease in the resistance of the Zener diode 117 so that the total resistance due to the first and second resistors 115, 116 and the Zener diode 117 between the DC power source 114 and the collector of the second transistor 110*b* accordingly decreases. As a result, the voltage supplied from the DC power source 114 to the collector of the second transistor 110*b* rapidly increases. Therefore, the degree of conduction of the first transistor 110*a* is able to be rapidly changed in a non-linear manner so as to accordingly alter the magnitude of a current to be absorbed through the collector and the emitter of the first transistor 110*a*.

A second switching element 118 in the form of a switching transistor is connected between the collector of the second transistor 110*b* and the wave form shaper 102 for controlling the operation of the current absorbing means 104 in response to the output signal of the wave form shaper 102. The switching transistor 118 has a base coupled via a resistor 119 with the output side of the wave form shaper 102, a collector coupled with the collector of the second transistor 110*b*, and an emitter grounded. The switching transistor 118 turns on the current absorbing means 104 when the wave form shaper 102 generates an output signal and turns it off at other times. Specifically, when the wave form shaper 102 outputs a pulse signal, the switching transistor 118 is turned on and made conductive so that a current supplied from the DC power source 114 to the collector of the second transistor 110*b* through the voltage regulator 113 flows to ground through the now conductive switching transistor 118 while bypassing the current mirror circuit 110. As a result, the current mirror circuit 118 is turned off or made non-conductive to stop its current absorbing function. On the other hand, when there is no output pulse generated by the wave form shaper 102, the switching transistor 118 is turned off or made non-conductive so that a current supplied from the DC power source 114 to the collector of the second transistor 110*b* flows through the bases and the emitters thereof to ground, thus turning on these transistors. Consequently, part of a positive portion of the signal generator output flows to ground through the now conductive first transistor 110*a* so that the signal generator output is partially absorbed. The magnitude of current thus absorbed varies according to the voltage supplied from the DC power source 114 to the collector of the second transistor 110*b* through the voltage regulator 113.

Now, the operation of the above embodiment will be described.

Figure 2A:
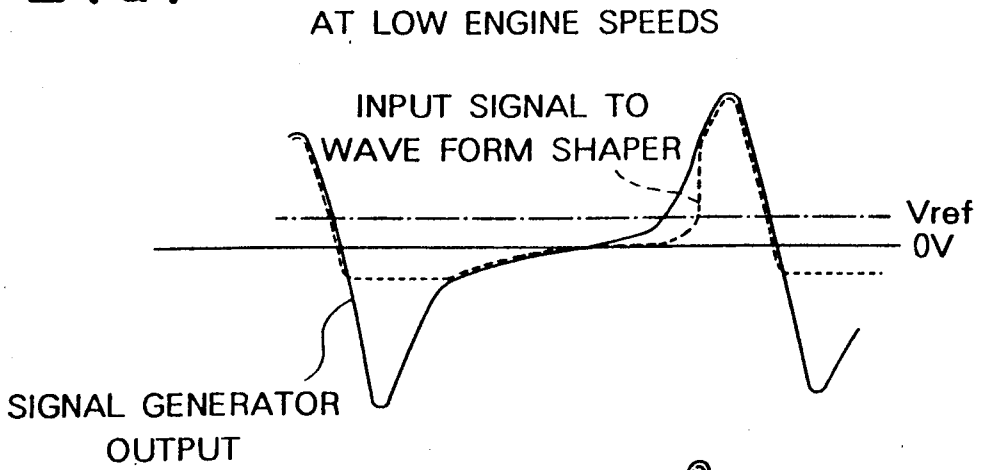
FIG. 2*a* is a wave form diagram showing the output signal of a signal generator (designated by the solid line) and the input signal at a first positive input terminal of a wave form shaper (designated by the broken line) of FIG. 1 at a low speed operation of the engine.
Figure 2B:
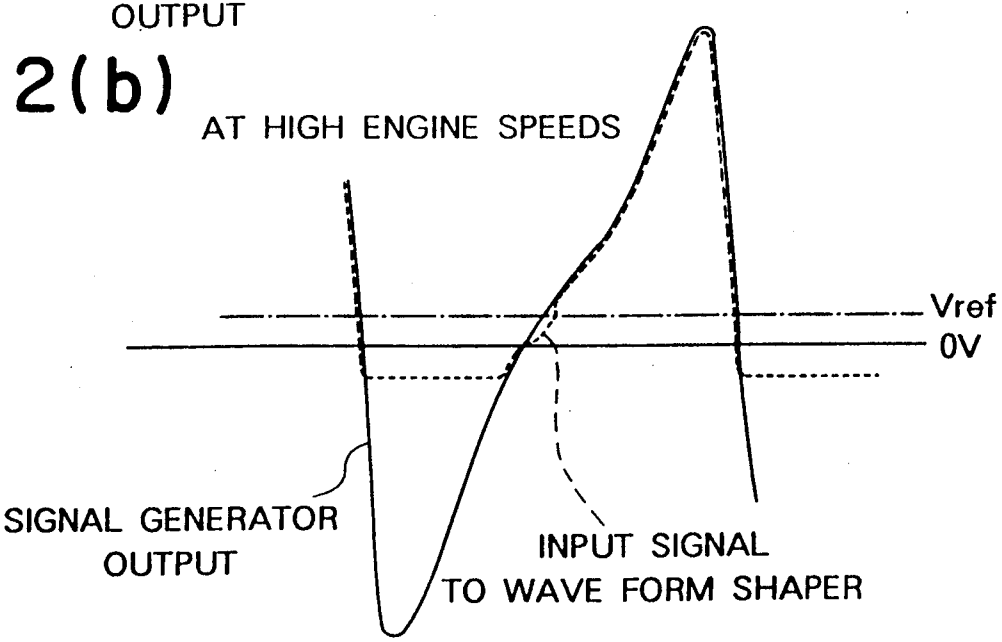
FIG. 2*b* is a wave form diagram similar to FIG. 2*a*, but showing the output signal of the signal generator (designated by the solid line) and the input signal at the first positive input terminal of the wave form shaper (designated by the broken line) of FIG. 1 at the time of a high speed operation of the engine.

First, the signal generator 101 generates an alternating output signal having a wave form, which is shown by the solid line in FIG. 2*a* or FIG. 2*b*, in synchrony with the rotation of the engine. The negative portions of the alternating output signal are clipped at a prescribed level by the diode 109 whereas the positive portions thereof are partially absorbed by the current mirror circuit 110, which is operative when the wave form shaper 102 generates no output pulse, in accordance with the magnitude of voltage (which may be simply referred to as the power source voltage) supplied from the DC power source 114 to the collector of the second transistor 110*b*, as described above. The rest of the signal generator output, which is shown by the broken line in FIG. 2*a* or FIG. 2*b*, is inputted to the first positive input terminal of the wave form shaper 102 where it is compared with the threshold voltage Vref fed to the second negative input terminal of the wave form shaper 102. When the signal generator output rises above the threshold voltage Vref, the wave form shaper 102 generates an output signal in the form of a square pulse which continues until the signal generator output falls below the threshold level Vref, so that the switching transistor 118 is made conductive. With the conduction of the switching transistor 118, the current mirror circuit 110 is disabled, thus stopping the absorption of the signal generator output. As a consequence, the wave form of the input signal fed to the first positive input terminal of the wave form shaper 102 is restored to the original non-absorbed wave form of the signal generator output, as clearly shown in FIGS. 2*a* and 2*b*. Thus, the wave form shaper 102 has a hysteresis characteristic.

As can be seen from FIG. 2*a*, when the engine operates at low speeds, the output level or magnitude of the signal generator 101 is relatively low and the signal inputted to the first positive input terminal of the wave form shaper 102 (indicated by the broken line in FIG. 2*a*) rises gradually or slowly as compared with the rising rate of the original or non-absorbed output signal of the signal generator 101 (indicated by the solid line in FIG. 2*a*). As a result, the length of each of the output pulses of the wave form shaper 102 supplied to the power transistor circuit 106 through the driver circuit 108 is reduced so that the power consumption of the ignition coil 105 is accordingly reduced. Thus, the duty cycle of the ignition apparatus as a whole is minimized in an effective manner.

On the other hand, as shown in FIG. 2*b*, when the engine runs at high speeds, the output level or magnitude of the signal generator 101 is relatively great and the signal inputted to the first positive input terminal of the wave form shaper 102 (indicated by the broken line in FIG. 2*b*) rises sharply substantially at the same rising rate as that of the original or non-absorbed output signal of the signal generator (indicated by the solid line in FIG. 2*b*), so that the time required for the input signal to rise from zero V to the threshold voltage Vref is relatively short. Therefore, the wave form shaper 102 provides an output pulse having substantially the same pulse width as that obtained with the original or non-absorbed output signal of the signal generator 101. Consequently, an adequate primary winding current for the high speed rotation of the engine can be obtained, thus providing substantially the same duty cycle as that obtained with the original or non-absorbed signal generator output.

According to this embodiment, a feedback loop for controlling a DC bias to the output signal of the signal generator based on the magnitude of primary winding current as conventionally employed can be eleiminated. This serves to simplify the entire circuit arrangement of the ignition apparatus, and reduce the number of external connection points between the signal generator 101 and the remaining portions of the ignition apparatus from two to one, as well as the number of component parts to be connected. Thus, the reliability of the overall ignition apparatus as a whole can be greatly improved and the manufacturing cost thereof can also be reduced.

Figure 3:
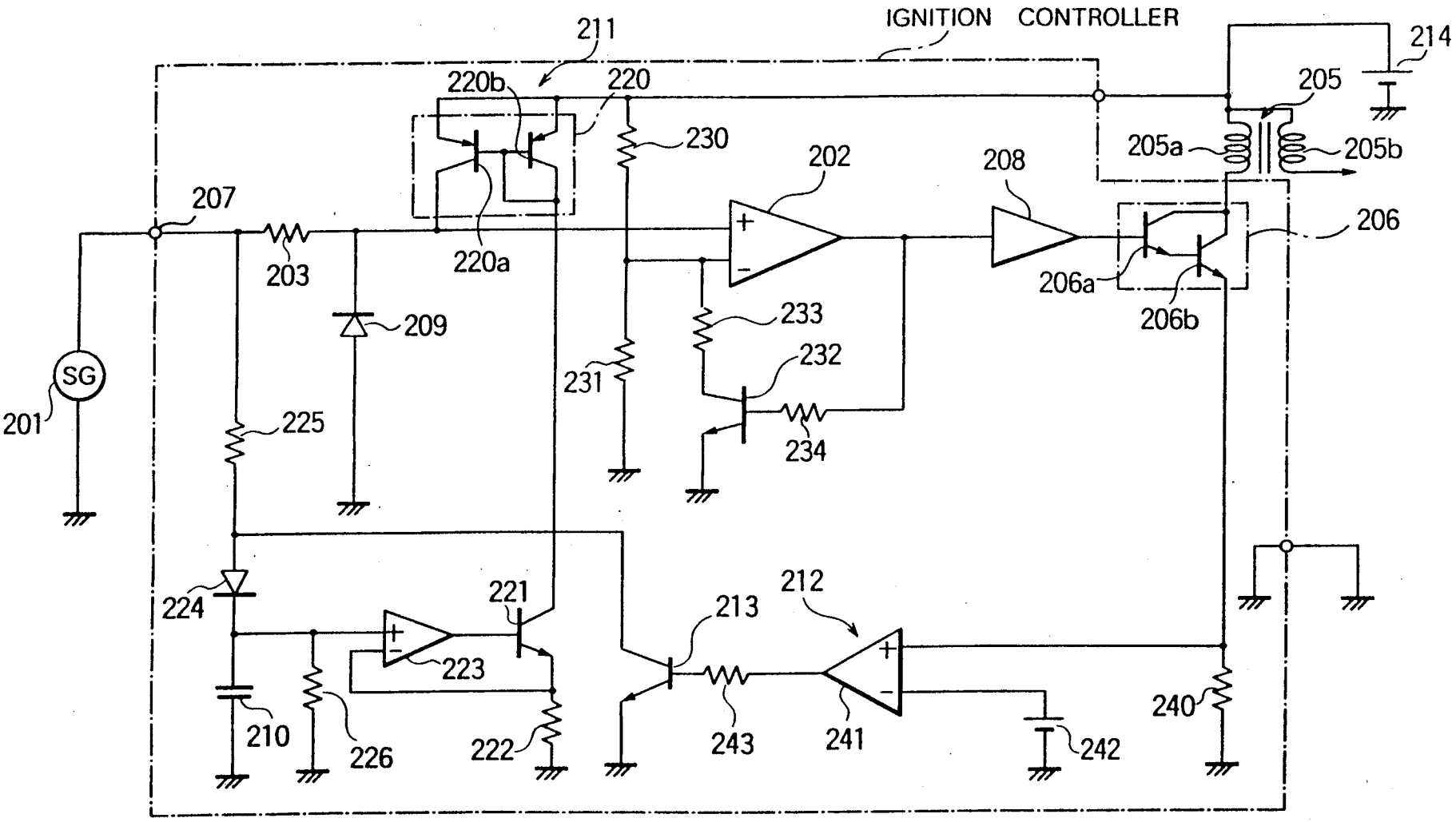
FIG. 3 is a circuit diagram of another embodiment of an ignition apparatus for an internal combustion engine according to the present invention.

FIG. 3 shows another embodiment of the present invention. The ignition apparatus of this embodiment includes, in addition to a signal generator 201, a wave form shaper 202, a resistor 203, an ignition coil 205, a first switching element or power transistor circuit 206, a driver circuit 208, a diode 209 and a DC power source 214, which are substantially the same as the elements 101, 102, 103, 105, 106, 108, 109 and 114 of the previous embodiment of FIG. 1 and which are connected with each other substantially in the same manner as in the previous embodiment, a capacitor 210 connected with a junction between the signal generator 201 and the resistor 203 so as to be charged by the alternating output signal of the signal generator 201, a current supplying means 211 connected between the resistor 203 and the wave form shaper 202 for supplying a direct current to the resistor 203 in accordance with the charged voltage across the capacitor 210, a current detecting circuit 212 for detecting a current flowing through the primary winding 205*a* of the ignition coil 205 and generating an output signal when the primary winding current reaches a prescribed level, and a bypass circuit 213 for bypassing the output signal of the signal generator 201 around the capacitor 210 in response to the output signal of the current detecting circuit 212 so that the charged voltage across the capacitor 210 is thereby controlled, adjusting the duty cycle of the first switching element 206.

The current supplying circuit 211 comprises a current mirror circuit 220 including a pair of first and second transistors 220*a*, 220*b*, and a switching transistor 221 for turning on and off the current mirror circuit 220. The first and second transistors 220*a*, 220*b* have their emitters commonly coupled with the DC power source 214 in the form of a battery and their bases commonly coupled with a collector of the second transistor 220*b*. The first transistor 220*a* has a collector coupled with one end of the resistor 203 which has the other end connected via an external connection point 207 with one end of the signal generator 201 which is grounded at the other end thereof. The switching transistor 221 has a collector coupled with the collector of the second transistor 220*b*, an emitter grounded through a resistor 222, and a base connected with an output terminal of a buffer circuit 223 in the form of a comparator. The buffer circuit 223 has a first positive input terminal coupled with one end of the capacitor 210 which is grounded at the other end thereof, and a second negative input terminal coupled with the emitter of the switching transistor 221 so that the voltage across the resistor 222 is applied to the second negative input terminal as a reference or threshold voltage. The capacitor 210 is coupled at one end with the signal generator 201 through a diode 224 and a resistor 225. The diode 224 has an anode coupled with the resistor 225 and a cathode coupled with the capacitor 210. A resistor 226 has one end grounded and the other end coupled to a junction between the diode 224 and the capacitor 210.

Figure 4:
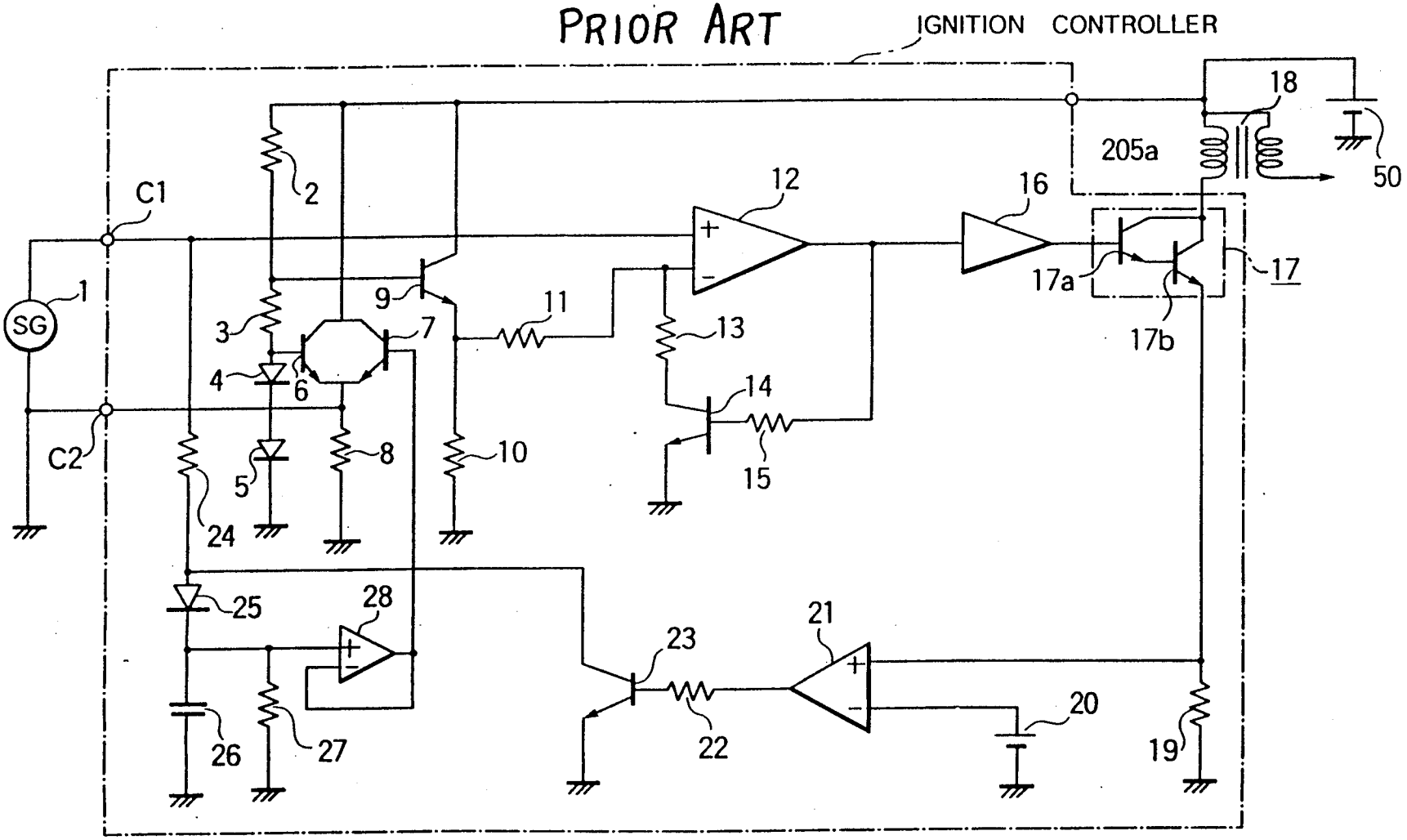
FIG. 4 PRIOR ART
FIG. 4 is a circuit diagram of a known ignition apparatus for an internal combustion engine.

The wave form shaper 202 has a first positive input terminal connected with the signal generator 201 through the resistor 203 in the same manner as in the previous embodiment, and a second negative input terminal connected with a junction between a pair of serial resistors 230, 231 and at the same time with a collector of a transistor 232 through a resistor 233. The serial resistors 230, 231 are connected with the positive terminal of the DC power source 214 and ground. The transistor 232 has a base coupled through a resistor 234 with the output terminal of the wave form shaper 202, and an emitter grounded. The transistor 232 and the resistors 230, 231, 233 and 234 operates to provide a variable threshold voltage at the second negative input terminal of the wave form shaper 202 substantially in the same manner as the elements 9 through 15 of the previously described known ignition apparatus of FIG. 4 does.

The current detecting circuit 212 comprises a current sensing resistor 240 having one end coupled with an emitter of a second power transistor 206*b* of the power transistor circuit 206 and the other end grounded, and a comparator 241 for detecting whether a voltage across the resistor 240 is greater than a prescribed reference voltage. The comparator 241 has a first positive input terminal coupled with a junction between the resistor 240 and the emitter of the second power transistor 206*b* so as to be applied by the voltage across the resistor 240, and a second negative input terminal onto which the prescribed reference voltage is imposed by a DC power source 242. The comparator 241 has an output terminal connected with the bypass circuit 213. The current detecting circuit 212 generates an output signal when the voltage at the first positive input terminal thereof is greater than the reference voltage at the second negative input terminal.

The bypass circuit 213 comprises a bypass transistor having a collector coupled with a junction between the diode 224 and the resistor 225, an emitter grounded, and a base coupled through the resistor 243 with the output terminal of the comparator 241 of the current detecting circuit 212.

In operation, when the engine is operating at high speeds, the signal generator 201 generates an alternating output signal which is fed to the first positive input terminal of the wave form shaper 202 through the resistor 203 and at the same time to the capacitor 210 through the resistor 225 and the diode 224 whereby the capacitor 210 is charged. As the signal generator output increases with increasing rotational speed of the engine, the charged voltage across the capacitor 210 increases in accordance with engine rotational speed. When the capacitor voltage inputted to the first input terminal of the buffer circuit 223 increases above a reference voltage applied to the second input terminal, the buffer circuit 223 generates an output signal which is fed to the base of the switching transistor 221, making it conductive. With the conduction of the switching transistor 221, both of the first and second transistors 220*a*, 220*b* of the current mirror circuit 220 are turned on or made conductive whereby part of the current flows from the DC power source 214 to ground through the second transistor 220*b*, the switching transistor 221 and the resistor 222, whereas the rest of the current is supplied from the DC power source 214 to the signal generator 201 through the first transistor 220*a* and the resistor 203 so as to raise the DC voltage level of the signal generator output. In this manner, the DC voltage level of the signal fed to the first positive input terminal of the wave form shaper 202 can be controlled in dependence upon the direct current flowing from the DC power source 214 to the signal generator 201 through the first transistor 220*a* and the resistor 203. As the current flowing from the DC power source 214 to ground through the second transistor 220*b* and the switching transistor 221 and the resistor 222 is varied according to the magnitude of the charged voltage across the capacitor 210 which is imposed on the base of the switching transistor 221, the current supplied from the DC power source 214 to the signal generator 201 via the first transistor 220*a* and the resistor 203 is changed by the magnitude of the capacitor voltage. Thus, the magnitude of the signal inputted to the wave form shaper 202 increases in accordance with increasing engine speed so that the pulse width of each output pulse of the wave form shaper 202 is accordingly increased. Since the conduction period of the power transistor circuit 206 is controlled by the pulse width of an output pulse of the wave form shaper 202 through the action of the driver circuit 208, the period of current supply from the DC power source 214 to the primary winding 205*a* of the ignition coil 205 becomes longer, providing a sufficient primary winding current for the high speed rotation of the engine.

When the voltage across the current sensing resistor 240 applied to the first positive input terminal of the comparator 241 increases above the reference voltage at the second negative input terminal (i.e., when the primary winding current reaches a prescribed upper limit), the comparator 241 generates an output signal which is fed via the resistor 243 to the base of the bypass transistor 213. Thus, the transistor 213 is made conductive so that the output signal of the signal generator 201 flows to ground through the resistor 225 and the transistor 213 while bypassing the capacitor 210. Accordingly, after the capacitor 210 has discharged below a predetermined voltage level, the switching transistor 221 is made non-conductive whereby the current mirror circuit 220 is turned off, stopping the current supply from the DC power source 214 to the signal generator 201 through the current mirror circuit 220 and the resistor 203. As a result, needless consumption of electric power is avoided.

On the other hand, when the engine runs at low speeds, the magnitude of the signal generator output is relatively small so that there is normally no satisfactory capacitor voltage charged to the capacitor 210 required for making the switching transistor conductive, leaving the current mirror circuit 220 inoperative. As a result, the signal inputted to the first positive input terminal of the wave form shaper 202 is the original output signal of the signal generator 201 alone, so the wave form shaper 202 generates an output pulse having a usual pulse width, thus avoiding any needless lengthening of the duty cycle of the power transistor circuit 206.

What is claimed is:

1. An ignition apparatus for an internal combustion engine comprising:

a signal generator for generating an alternating output signal in synchrony with the rotation of the engine;

a wave form shaper connected to receive the output signal of said signal generator for shaping the generator output signal using a predetermined threshold, said wave form shaper generating an output signal when the output signal of said signal generator is greater than the predetermined threshold;

a resistor connected in series with said signal generator and said wave form shaper;

current absorbing means connected between said resistor and said wave form shaper for absorbing part of the output signal of said signal generator supplied to said wave form shaper through said resistor in response to the output signal of said wave form shaper;

an ignition coil having a primary winding and a secondary winding; and a first switching element for controlling primary winding current of said ignition coil based on the output signal of said wave form shaper.

2. An ignition apparatus as claimed in claim 1, wherein said current absorbing means comprises:

a current mirror circuit including a pair of first and second transistors having their bases commonly coupled with a collector of said second transistor, and their emitters grounded, said first transistor having a collector coupled with said resistor;

a second switching element connected between the collector of said second transistor and said wave form shaper for controlling the operation of said current absorbing means in response to the output signal of said wave form shaper, said second switching element being operable to disable said current absorbing means when said wave form shaper generates an output signal and enable it at other times;

a DC power source; and a voltage regulator connected between said DC power source and the collector of said second transistor for regulating the voltage supplied from said DC power source to the second transistor collector whereby the output signal of said signal generator inputted to said wave form shaper is reduced in dependence upon the collector voltage of said second transistor applied thereto by said DC power source so as to reduce the duty cycle of said first switching element.

3. An ignition apparatus as claimed in claim 2, wherein said second switching means comprises a switching transistor having a base coupled with the output side of said wave form shaper, a collector coupled with the collector of said second transistor, and an emitter grounded.

4. An ignition apparatus as claimed in claim 2, wherein said voltage regulator comprises a first resistor connected between said DC power source and the collector of said second transistor, a second resistor and a Zener diode connected in series with said second resistor, said second resistor and said Zener diode being connected between said DC power source and the collector of said second transistor in parallel with said first resistor.

5. An ignition apparatus as claimed in claim 1, wherein said signal generator has one end connected with said resistor and the other end connected to ground.

6. An ignition apparatus for an internal combustion engine comprising:

a signal generator for generating an alternating output signal in synchrony with the rotation of the engine;

a wave form shaper connected to receive the output signal of said signal generator for shaping the generator output signal using a predetermined threshold, said wave form shaper generating an output signal when the output signal of said signal generator is greater than the predetermined threshold;

a resistor connected in series with said signal generator and said wave form shaper;

a capacitor connected to receive the alternating output signal of said signal generator so as to be charged thereby;

current supplying means connected between said resistor and said wave form shaper for supplying a direct current to said resistor in accordance with the charged voltage across said capacitor;

an ignition coil having a primary winding and a secondary winding;

a first switching element for controlling primary winding current of said ignition coil based on the output signal of said wave form shaper;

a current detecting circuit for detecting a current flowing through the primary winding of said ignition coil and generating an output signal when the primary winding current reaches a prescribed level; and a bypass circuit for bypassing the output signal of said signal generator around said capacitor in response to the output signal of said current detecting circuit so that the charged voltage across said capacitor is thereby controlled, adjusting the duty cycle of said switching element.

7. An ignition apparatus as claimed in claim 6, wherein said current supplying circuit comprises:

a DC power source;

a current mirror circuit including a pair of first and second transistors having their emitters commonly coupled with said DC power source and their bases commonly coupled with a collector of said second transistor, said first transistor having a collector coupled with said resistor; and a switching transistor having a collector coupled with the collector of said second transistor, an emitter grounded through a resistor, and a base connected through a buffer circuit with said capacitor, said buffer circuit having a first input terminal coupled with said capacitor, a second input terminal coupled with the emitter of said switching transistor and an output terminal coupled with the base of said switching transistor.

8. An ignition apparatus as claimed in claim 7, wherein said bypass circuit comprises a bypass transistor having a collector coupled between said signal generator and said capacitor, an emitter grounded and a base coupled through a resistor with said current detecting circuit.

9. An ignition apparatus as claimed in claim 6, wherein said signal generator has one end connected with said resistor and the other end connected to ground.

* * * * *